US005527090A

United States Patent [19]

Cone, II

[11] Patent Number: 5,527,090

[45] Date of Patent: Jun. 18, 1996

[54] CHILD SEAT TRAY ASSEMBLY

[75] Inventor: Richard E. Cone, II, Athens, Ohio

[73] Assignee: Cosco, Inc., Columbus, Ind.

[21] Appl. No.: 334,599

[22] Filed: Nov. 4, 1994

[51] Int. Cl.[6] ..... A47B 39/00; A47B 83/02

[52] U.S. Cl. ..... 297/149; 297/153

[58] Field of Search ..... 297/148, 149, 297/151, 153; 108/46, 143

[56] References Cited

U.S. PATENT DOCUMENTS

| | | | |
|---|---|---|---|
| D. 138,067 | 6/1944 | Morando | D15/8 |
| D. 147,540 | 9/1947 | Engelberg et al. | D15/1 |
| D. 207,779 | 5/1986 | Gunell | D15/1 |
| 1,983,138 | 12/1934 | Lehman | 155/127 |
| 2,505,490 | 4/1950 | Greenbaum | 155/127 |
| 2,799,324 | 7/1957 | Anderson | 155/127 |
| 3,330,397 | 7/1967 | Lay et al. | 397/148 |
| 3,475,052 | 10/1969 | Kiaposi | 297/153 |
| 3,649,074 | 3/1972 | McDonald et al. | 297/153 |
| 4,105,247 | 8/1978 | Saint | 297/149 |
| 4,181,356 | 1/1980 | Fleischer | 297/377 X |
| 4,265,481 | 5/1981 | Fleischer | 297/464 X |
| 4,344,649 | 8/1982 | Fleischer | 297/68 |
| 4,521,052 | 6/1985 | Cone | 297/250.1 |
| 4,582,359 | 4/1986 | Wise et al. | 297/151 |
| 4,603,902 | 8/1986 | Maloney | 297/35 |
| 4,723,813 | 2/1988 | Kassai | 297/153 |
| 4,807,928 | 2/1989 | Cone | 297/153 |
| 4,842,331 | 6/1989 | Waples | 297/149 |
| 4,867,506 | 9/1989 | Chavez | 297/153 |
| 4,938,603 | 7/1990 | Turner et al. | 297/16 |
| 4,962,965 | 10/1990 | Glover | 297/467 |
| 4,968,092 | 11/1990 | Giambrone | 297/151 |
| 5,118,161 | 6/1992 | Slow et al. | 297/151 |
| 5,165,755 | 11/1992 | Rho | 297/345 |
| 5,183,311 | 2/1993 | Meeker et al. | 297/151 |

FOREIGN PATENT DOCUMENTS 461807 12/1949 Canada .

OTHER PUBLICATIONS

Contemporary *Flair Chair*™ Instruction Sheet No. 4358–1959, Cosco (A Dorel Company), one page, 7 figures, date unknown.

*Right Height*™ *(270195) and Celebrity*™ (271181) Evenflo product advertisement, one page, date unknown.

*Primary Examiner*—Peter M. Cuomo
*Assistant Examiner*—Anthony D. Barfield
*Attorney, Agent, or Firm*—Barnes & Thornburg

[57] ABSTRACT

A seat tray assembly is provided for use with a high chair. The seat tray assembly includes a tray bottom formed for engagement with and extension between arms of the chair and a tray top mounted on the tray bottom for sliding movement relative to and above the tray bottom. In addition, the tray assembly includes a lock unit for selectively locking the tray top on the tray bottom to cause the slidable tray top to occupy a memory position lying on the tray bottom so that the tray top is returned automatically to the memory position each time the tray bottom is mounted on the arms of the chair.

48 Claims, 6 Drawing Sheets

CHILD SEAT TRAY ASSEMBLY

BACKGROUND AND SUMMARY OF THE INVENTION

This present invention relates to child seat trays, and particularly to adjustable child seat trays. More particularly, the present invention relates to a child seat tray that is movable either toward or away from the seat back of a child seat after it is attached to the side arms of a child seat.

Conventional high chairs are designed to accommodate children of different sizes as well as growing children. Typically, each high chair has a tray that can be mounted on side arms of the high chair to provide a table surface for a child seated in the high chair. Such a conventional tray can usually be moved either toward or away from the seat back of the high chair to allow the high chair to accommodate children of different sizes. Typically, a caregiver will adjust the tray so that it lies in a retracted position close to the seat back in the case of a small child or in an extended position farther away from the seat back in the case of a larger child. See, for example, U.S. Pat. Nos. 4,603,902 to Maloney and 4,936,603 to Turner, et al. for descriptions of high chair trays.

Since a child grows slowly, it is not necessary to change the position of the tray relative to the seat back very often to accommodate any one child in a high chair. However, due to the configuration of many conventional trays, the caregiver must always make an effort to move the tray relative to the seat back to its proper position on the high chair each time the tray is reattached to the high chair. It can be difficult and bothersome for a caregiver to adjust the position of the tray on the high chair to accommodate a child many times each day. Caregivers will know that it is often necessary to remove a tray from a high chair either to clean the tray or to lift a child out of the high chair seat.

The act of mounting a conventional tray to a high chair can itself be a frustrating or burdensome event if it is necessary for a caregiver to manually operate a pair of spaced-apart high chair-gripping assemblies mounted on the tray and the caregiver has only one hand available for the task. Caregivers, many times, must mount a tray on a high chair while holding or watching a fussy infant or toddler. Although many well-known trays having conventional high chair-gripping clamp assemblies are in widespread use, caregivers will welcome an improved tray having a high chair mounting device that is less cumbersome to operate than traditional clamp assemblies.

What is needed is a child seat tray assembly that can be mounted easily on a high chair and has a "memory" so that it will automatically occupy a pre-determined position relative to the seat back each time the tray is mounted on the high chair. Ideally, the memorized or pre-determined position of the tray can be selected by a caregiver using only one hand while the tray is mounted on the high chair side arms. Then, each time the caregiver reattaches the tray to the high chair the tray will occupy its pre-determined position.

According to the present invention, a child seat tray assembly is provided for use on a child seat. The tray assembly includes a tray bottom and a tray top mounted for sliding movement on the tray bottom. The tray assembly further includes means for locking the tray top on the tray bottom so that it occupies a memorized pre-determined position relative to the seat back. So, every time a caregiver attaches the tray bottom on the arms of the chair, the tray top is situated in the memorized position automatically without further adjustment.

In preferred embodiments of the present invention, the tray top is locked in the memorized position on the tray bottom by a locking mechanism. This locking mechanism includes a flat generally rectangular tray lock unit positioned between the tray top and tray bottom and a L-shaped tray top retention latch mounted on the lock unit for movement into and out of locking engagement with the tray top. Additionally, the lock unit is normally spring biased toward the seat back to move the latch carried on the lock unit into engagement with several latch posts mounted on the tray bottom.

The latch pivots about a pivot post appended to the underside of the tray top. The latch includes a head portion at one end for engagement in one of several slots formed in the tray bottom to establish a fixed position of the tray top relative to the tray bottom. The latch also includes a tail portion at an opposite end for connection to the lock unit.

The lock unit itself includes a slidable base and a pivot bar which is appended to the slidable base and arranged to extend toward the tray top and is coupled to the tail portion of the pivotable latch. The tail portion of the latch is formed to include a slot receiving the pivot bar and allowing sliding movement of the pivot bar therein to create a bell crank mechanism for pivoting the latch in response to sliding movement of the spring-biased lock unit. In use, as the lock unit is normally urged toward the seat back, the pivot bar moves through the slot to pivot the latch into engagement with latching posts formed on the tray bottom. These latching posts engage the pivoting L-shaped latch to fasten the tray top in a fixed "memorized" position relative to the underlying tray bottom.

Moreover, a handle is appended to the flat lock unit and arranged to extend out of an aperture defined by the tray top and an adjacent tray bottom so that a caregiver can grip the handle using a single hand. In use, the caregiver can move the handle to control pivoting of the latch about the pivot post appended to the underside of the tray top and relative to the latching posts formed on the tray bottom. As the caregiver pulls the handle to move the slidable lock unit against the biasing spring, the pivot bar appended to the lock unit moves away from the seat back and through the slot formed in the tail portion of the latch to pivot the latch about its pivot post away from the latch posts formed on the tray bottom to a latch post-disengaging position. This disengaging position releases the tray top from its fixed position relative to the tray bottom and allows the caregiver to slide the tray top relative to the tray bottom that is mounted in a fixed position on side arms of a high chair. Since the lock unit is normally spring biased toward the seat back, the lock unit snaps toward the seat back and the latch automatically pivots about its pivot post on the tray top into engagement with the latch posts formed on the tray bottom once the caregiver releases handle. Thus, the tray top is locked automatically in a new memorized position relative to the tray bottom.

Preferably, the tray assembly includes a mounting mechanism positioned between the tray top and the tray bottom and configured to permit a caregiver to attach the tray bottom easily to the child seat in a fixed locked position. The mounting mechanism includes a locking bar which extends across the width of the tray bottom and over the high chair arms and spring-biased L-shaped mounting latches affixed to the locking bar. The tray bottom itself includes a tray-receiving passageway formed for extension of the latches therethrough and guiding portions surrounding the passageways and having an inner end facing the chair seat. The latches extend through the guiding portions and are normally spring biased into engagement with the inner ends of the guiding portion.

Each guiding portion is sized for extension into tray mounting portions formed within the arms and having a mounting lip positioned therein. The spring-biased mounting latch sandwiches the mounting lip between itself and the inner end of the respective guiding portion to lock the tray bottom on the arms of the child seat. Additionally, a lever is mounted on each of the opposite ends of the bar so that a caregiver can easily lift the lever to pivot the bar on the tray bottom and yieldably urge the mounting latch away from the mounting lip so that the tray bottom may be removed from a mounted position on the arms of the child seat.

The initial development of the tray assembly was undertaken to create a child seat tray which has a set memorized position relative to the seat back and which can be periodically adjusted on the chair seat to accommodate a growing child. Due to the fixed position of the tray bottom on the seat, it was desirable to create suitable means for locking the tray top in the memorized position and for adjusting the tray top on the tray bottom in front of a child seated in the child seat. The function of the locking mechanism is to allow the caregiver, with one hand, to lock the tray top on the tray bottom so that it occupies the memorized position every time the tray assembly is mounted on the high chair. This is accomplished by the latch which is yieldably spring biased into engagement with latch posts formed on the tray bottom.

The function of the mounting mechanism in combination with the guiding portions is to allow the caregiver to snap the tray assembly onto the chair in one motion and to remove the assembly from the chair by easily lifting one latch-release lever. This is accomplished by spring-biased mounting latches and latch-release levers mounted on the locking bar. The mounting latches are positioned within guiding portions and are spring biased for engagement with the guiding portion itself. The guiding portions are pressed into the tray-receiving passageway formed in the arms until the mounting latches engage the mounting lip and then snap into place. Raising either latch-release lever pivots the latch away from the mounting lip so that the guiding portion may be easily lifted out of the tray-receiving passageway.

It is quite simple to adjust the pre-determined memorized position of the tray top relative to the seat back. The caregiver must only pull a handle affixed to the lock unit away from the seat back until the latch disengages the latch posts formed on the tray bottom. The caregiver may then slide the tray top relative to the tray bottom between an expanded position and a retracted position. To reset the memorized fixed position, the caregiver must simply release the handle. The latch mounted on a pivot post appended to the tray top automatically snaps into engagement with the latch posts formed on the tray bottom to fix the tray top in a fixed position relative to the tray bottom.

It is also simple to mount a child seat tray assembly in accordance with the present invention on a seat. The caregiver must only extend the guiding portions through the tray-receiving passageway in the arms until the mounting latches snap past the mounting lip. The snapping sound serves as an indication to the caregiver that the tray bottom is securely locked within the tray mount. To remove the tray assembly from the chair, the caregiver must only lift the latch-release lever and lift the guiding portions from the tray mount.

Additional objects, features, and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
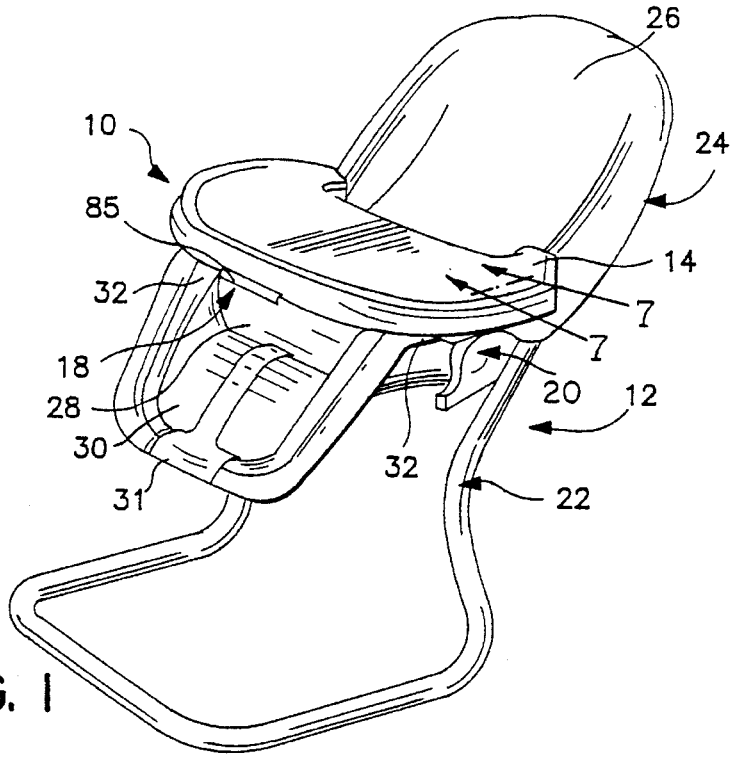
FIG. 1 is a perspective view of a child seat having a chair frame, a chair seat which includes a back portion, a seating portion, a leg-resting portion, and elevated arms, a T-shaped restraining bar positioned upon the leg-resting portion, and a seat tray assembly mounted upon the arms of the chair seat.

A child seat tray assembly 10 in accordance with the present invention is shown in FIG. 1 as it would appear to a caregiver after it has been mounted onto a child seat 12. The assembly provides a tray top 14 mounted for sliding movement on a tray bottom 16, a locking mechanism 18 positioned between the tray top 14 and the tray bottom 16 to fix the tray top 14 in a memorized locked position on the tray bottom 16, and a mounting mechanism 20 for rigidly attaching the tray bottom 16 onto the seat 12. The locking mechanism 18 fixes the tray top 14 on the tray bottom 16 so that the tray top 14 is locked automatically in the memorized position each time the mounting mechanism 20 is fixed onto the seat 12.

Ideally, the tray assembly 10 is securely attached to the child seat 12 which is configured to support the tray bottom 16 (FIG. 1). Preferably, seat 12 includes a high-chair frame 22 and a chair 24 positioned on the frame 22. The chair 24 includes a back portion 26, a seating portion 28, a leg-support portion 30, a child-restraining portion 31, and a pair of arms 32. These arms 32 are configured to receive the tray bottom 16 thereon for locking the tray assembly 10 onto the chair 24.

Figure 2:
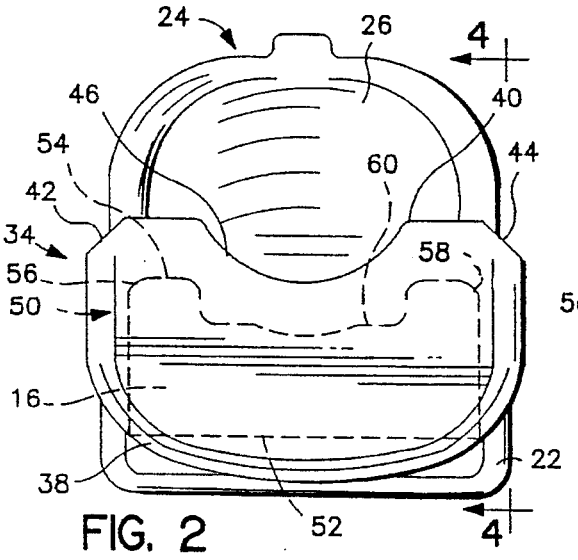
FIG. 2 is a top view of the child seat of FIG. 1, showing the back portion of the chair seat and the chair frame, and showing the tray top in a memorized retracted position toward the back portion of the chair seat and the tray bottom (in phantom) in a fixed locked position upon the chair seat.
Figure 3:
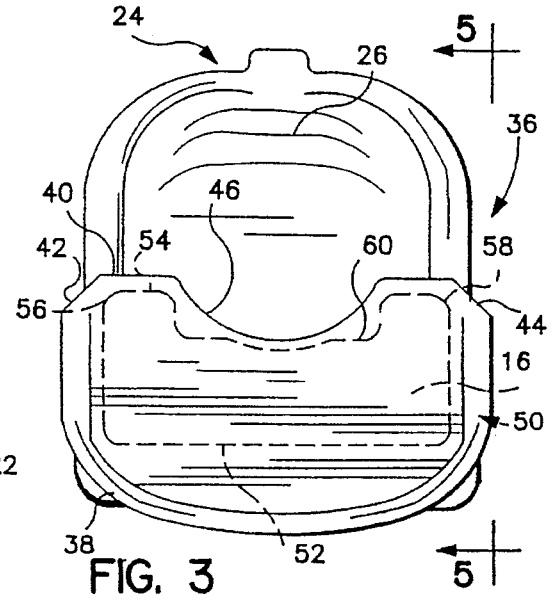
FIG. 3 is a view of the child seat of FIG. 2, showing the tray top after it has been adjusted to its memorized expanded position away from the back portion of the chair seat and showing the tray bottom (in phantom) remaining in its fixed locked position upon the chair seat.
Figure 4:
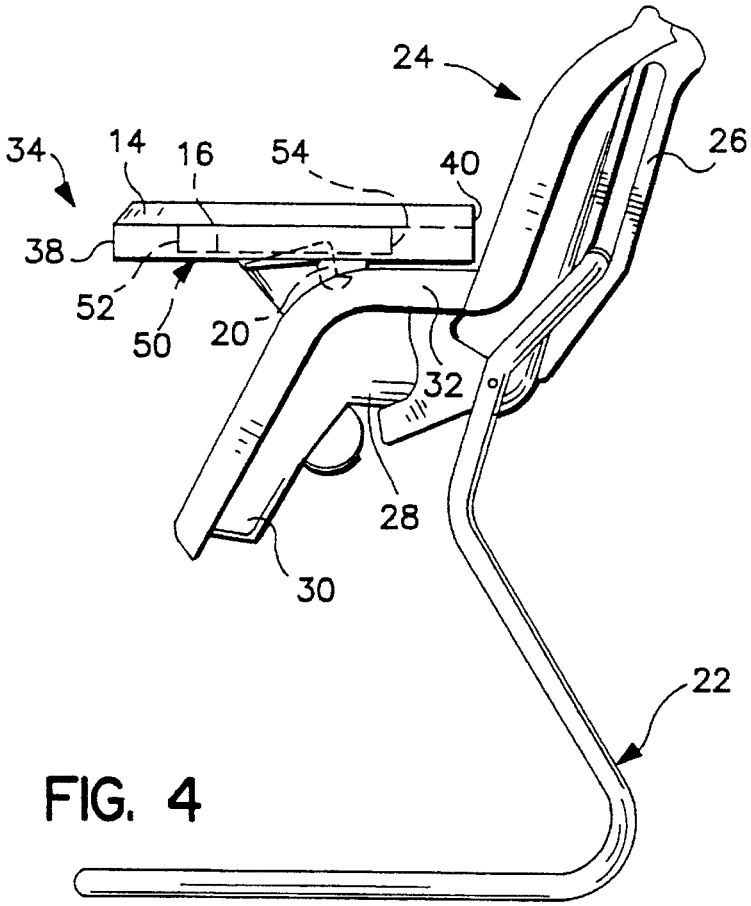
FIG. 4 is a side view of the chair taken along line 4—4 of FIG. 2, showing the tray top in the retracted position and the tray bottom (in phantom) in its fixed locked position upon the arms of the seat, and showing a mounting latch (in phantom) biased in one arm to a position locking the tray bottom to one of the arms in the chair seat.

After tray assembly 10 is mounted on the chair 24, the tray top 14 may slide on the tray bottom 16 to move between a memorized fully-retracted position 34 as shown in FIG. 2, and a memorized fully-expanded position 36 as shown in FIG. 3. The sliding tray top 14 allows the caregiver to easily adjust positioning of the tray top 14 relative to both the tray bottom 16 and the back portion 26 while the child is seated in the chair 24. In the retracted position 34, the tray top 14 is locked on the tray bottom 16 and lies adjacent to the back portion 26 of the chair 24 as shown in FIGS. 2 and 4.

Referring now to FIG. 2, the tray top 14 additionally includes a convex outward edge 38 extending outwardly over the frame 22 and an opposite inward edge 40. Ideally, the inward edge 40 includes opposite ends 42, 44 and a concave child-receiving edge 46 extending therebetween. This child-receiving edge 46 allows the opposite ends 42, 44 of the inward edge 40 to lie close the back 26 of the chair 24 while still allowing a smaller child to sit comfortably on the seating portion 28 between the tray top 14 and the back 26 of the chair 24.

Figure 5:
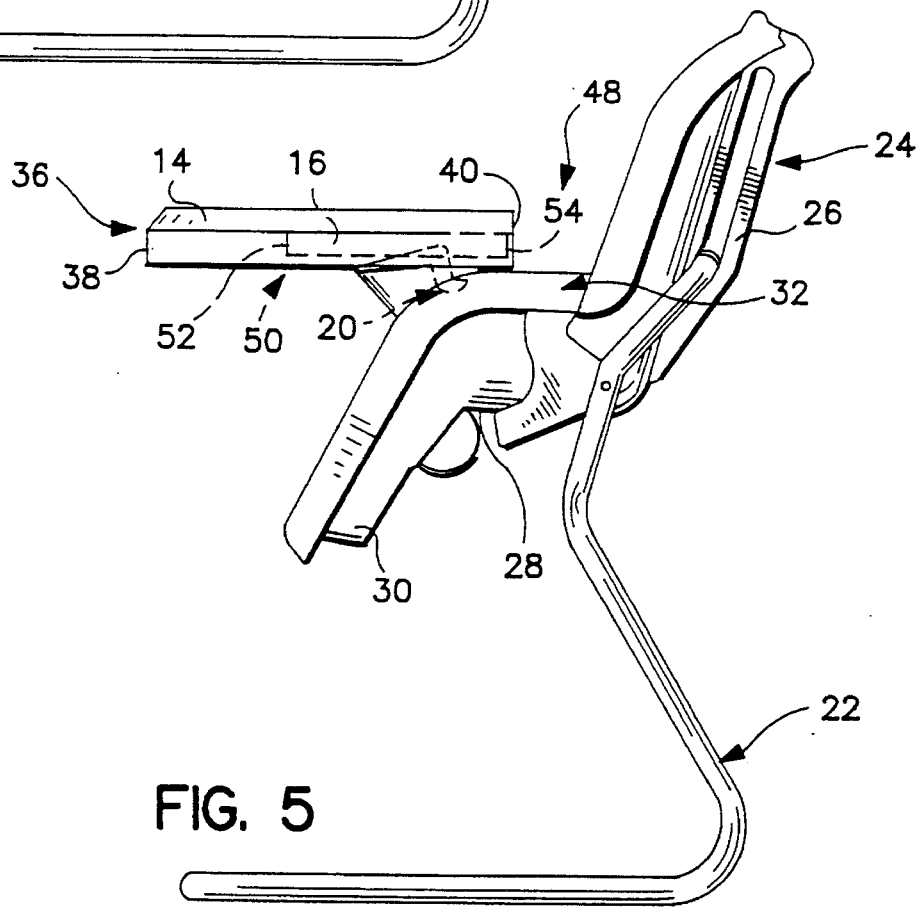
FIG. 5 is a side view of the chair taken along line 5—5 of FIG. 3, showing the tray top in the expanded position and the tray bottom (in phantom) in its fixed locked position upon the arms of the seat, and showing the mounting latch (in phantom) biased in one arm of the child seat to the same position shown in FIG. 4.

The tray assembly 10 as it would appear in the fully-expanded position 36 is illustrated in FIGS. 3 and 5. Referring to FIG. 5, the tray top 14 in the expanded position 36 lies outwardly relative to the back portion 26 of the chair 24 and extends over the leg-support portion 30. Thus, the opposite ends 42, 44 of the inward edge 40 of the tray top 14 are positioned above the tray bottom 16 rather than adjacent to the chair back 26. This memorized expanded position 36 gives a larger child more space 48 between the child-receiving edge 46 and the back 26 of the chair 24.

Furthermore, as illustrated by dotted lines in FIGS. 2 and 3, the tray bottom 16 does not move with the tray top 14 from the retracted position 34 to the expanded 36 position. The tray bottom 16 rather remains in a fixed locked position 50 on the chair 24. Additionally, the tray bottom 16 includes an exterior side 52 and an interior side 54 facing the back portion 26 of the chair 24. This interior side 54 has a first opposite edge 56, a second opposite edge 58, and a concave region 60 extending therebetween. The concave region 60 is shaped so as to be aligned with the child-receiving edge 46 formed in the tray top 14, after the tray top 14 has been fixed in its memorized expanded position 36. Thus, the interior side 54 of the tray bottom 16 does not extend into the space 48 between the child-receiving edge 46 and the back 26 of the chair 24, but remains positioned between the tray top 14 and the seating portion 26.

Figure 6:
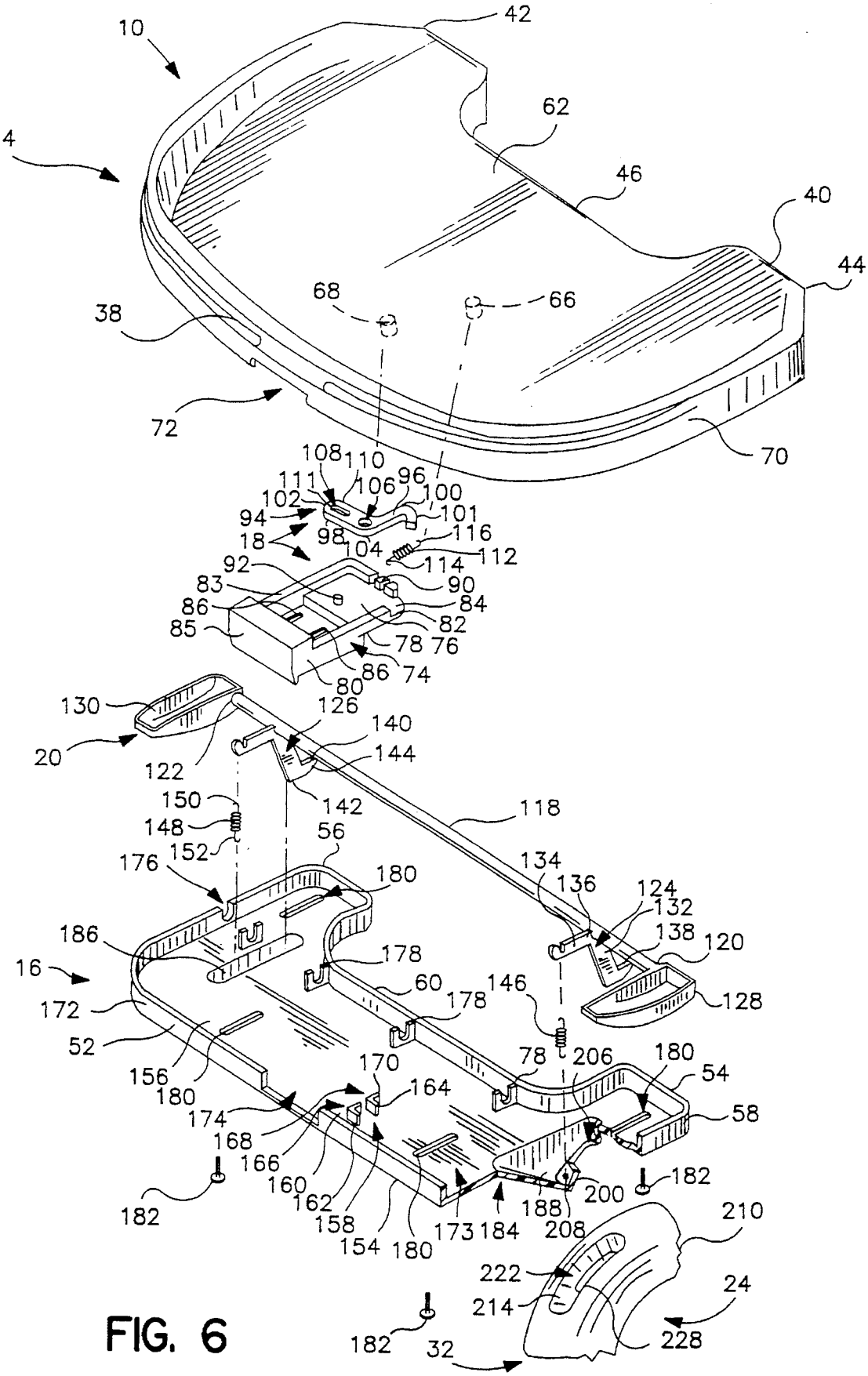
FIG. 6 is an exploded assembly view of the seat tray assembly of FIG. 1 showing a tray top, a locking mechanism including a spring-biased lock unit, a latch, and several latch posts mounted on a tray bottom, a handle affixed to the lock unit, a mounting mechanism having a locking bar and spring-biased mounting latches, and a tray bottom including guiding portions, and also showing an arm of a chair having a tray mount with a mounting lip therein for receiving one of the mounting latches included in the mounting mechanism.

Referring now to FIG. 6, the tray top 14 includes an outward side 62 and an inward side 64 facing the tray bottom 16. The inward side 64 is formed to include a mounting post 66 which extends in an inward direction toward the underlying tray bottom 16 and a pivot post 68 which also extends in the inward direction and lies in spaced-apart parallel relation to the mounting post 66. Additionally, a border 70 is positioned about the perimeter of the tray top 14 and is formed to extend in the inward direction past the locking mechanism 18, the mounting mechanism 20, and the tray bottom 16. The border 70 also has an aperture 72 formed in a front edge 38 thereof.

The locking mechanism 18 includes a lock unit 74 which is joined to the tray top 14 for limited sliding movement therewith. The lock unit 74 includes a top side 76, a bottom side 78 facing the tray bottom 16, a outside end 80, and an opposite inside end 82 as shown in FIG. 6. Preferably, the lock unit 74 includes a rim 83 extending about the perimeter of the top side 76. The rim 83 has a notch 84 formed therein. Preferably, a handle 85 is coupled to the outside end 30 of the lock unit 74 and formed to slide through the aperture 72 to enable a caregiver gripping the handle 85 to pull the lock unit 74 away from the back portion 26 of the chair 24.

Ideally, the lock unit 74 is formed to include unit-guiding slots 86 extending between the top side 76 and the bottom side 78 for joining the lock unit 74 to the inward side 64 of the tray top 14. A screw, headed rivet, rod, pin, or comparable connection device 87 (see FIG. 9) is formed to extend outwardly through each guiding slot 86 and into the tray top 14. Each guiding slot 86 is sized to permit sliding movement of the connection device 87 therein so that the lock unit 74 may undergo limited guided sliding movement relative to the tray top 14. Preferably, the lock unit 74 includes a spring mount 90 on the inside end 82 and a pivot bar 92 coupled to the top side 76 as shown in FIG. 6.

Additionally, locking mechanism 18 is formed to latch the tray top 14 to the tray bottom 16 so that the tray top 14 occupies a pre-determined memorized position relative to the seat back 28 each time the tray bottom 16 is fixed on the arms 32 of the seat 24. The locking mechanism 18 includes a latch 94 having an outermost surface 96 facing the tray top 14 and an innermost surface 98 formed to be movably joined with the lock unit 74. Continuing to refer to FIG. 6, the latch 94 has a head portion 100 with a tab 101 extending outwardly therefrom and a tail portion 102. A central pivot portion 104 is included in the latch 94 and located between the head portion 100 and the tail portion 102. Central pivot portion 104 is formed to include a pivot aperture 106 extending between the outermost surface 96 and the innermost surface 98. This pivot aperture 106 is sized for extension of the pivot post 68 formed on the underside of tray top 14 therethrough to permit the latch 94 to pivot freely about its central pivot portion 104 during sliding movement (back and forth) of the lock unit 74 inside the space provided between tray top 14 and tray bottom 16.

Further, the latch tail portion 102 is formed to include a slot 108 extending between the outermost surface 96 and the innermost surface 98. The slot 108 includes a first end 110 and an opposite second end 111 and is sized to permit sliding movement of the pivot bar 92 formed on the lock unit 74 between the opposite ends 110, 111 of slot 108. In use, sliding lock unit 74 back and forth in the space between tray top and bottom 14, 16 moves pivot bar 92 against latch tail portion 102 to cause latch 94 to pivot about the pivot post 68 formed on the underside of tray top 14. Such pivoting movement of latch 94 causes the latch head portion tab 101 to move into and out of engagement with mounting notches 166, 168 formed in tray bottom 16 in the manner described below to lock and unlock the tray top 14 to and from the tray bottom 16.

The locking mechanism 18 also includes a compression spring 112 having an inner end 114 formed to engage the spring mount 90 and an outer end 116 formed to engage the mounting post 66. Compression spring 112 yieldably biases the lock unit 74 to the position shown in FIG. 9 in which latch tail head portion tab 101 fits in one of the mounting notches 166, 168, 169 formed in tray bottom 16.

Ideally, the mounting mechanism 20, as shown in FIG. 6, includes a locking bar 118 having opposite ends 120, 122, mounting latches 124, 126, and latch-release levers 128, 130. Preferably, the mounting latches 124, 126 are positioned on the locking bar 118 between the opposite ends 120, 122 so that each mounting latch 124, 126 is aligned with the respective arms 32 of the chair 24. Additionally, the bar 118 extends across the width of the tray bottom 16 and over the arms 32 of the chair 24. Since the first latch-release lever 128 is positioned on the first end 120 of locking bar 118 and the second lever 130 is positioned on the second end 122 of locking bar 118, a caregiver may have easy access to the latch-release levers 128, 130 to remove the tray assembly 10 from the chair 24. The mounting latches 124, 126 and levers 128, 130 are securely fixed on the locking bar 118 so that the mounting latches 124, 126 and levers 128, 130 pivot as a unit on the locking bar 118 relative to the tray bottom 16. So, the caregiver must only lift one of the levers 128, 130 to disengage the mounting latches 124, 126 from the arms 32. Advantageously, this feature facilitates one-handed release of the tray assembly 10 from the chair 24 by a caregiver.

Each mounting latch 124, 126 includes a locking end 132, a spring-retention end 134, and a center pivot portion 136 coupled to the locking bar 118. Preferably, as shown in FIG. 6, the locking end 132 of the mounting latches 124, 126 includes a catch 138 extending toward the seat back 26 and having an outward portion 140 formed to face the tray bottom 16 and an inward portion 142. Ideally, the catch 138 includes a tapered portion 144 positioned on the inward portion 142. The mounting mechanism 20 further includes locking springs 146, 148, each having an outward end 150 formed for engagement with the spring-retention end 134 of the mounting latches 124, 126 and an inward end 152 formed for engagement with the tray bottom 16.

The tray bottom 16 itself has an inner surface 154 facing the seating portion 26 and an outer surface 156 facing the inward side 64 of the tray top 14 and supporting several latch posts 158 of the locking mechanism 84. These latch posts 158 are coupled to the outer surface 156 and are arranged to extend toward the inward side 64 of the tray top 14 and engage the latch 94 to establish one of the memorized positions of the tray top 14 relative to the tray bottom 16.

Figure 9:
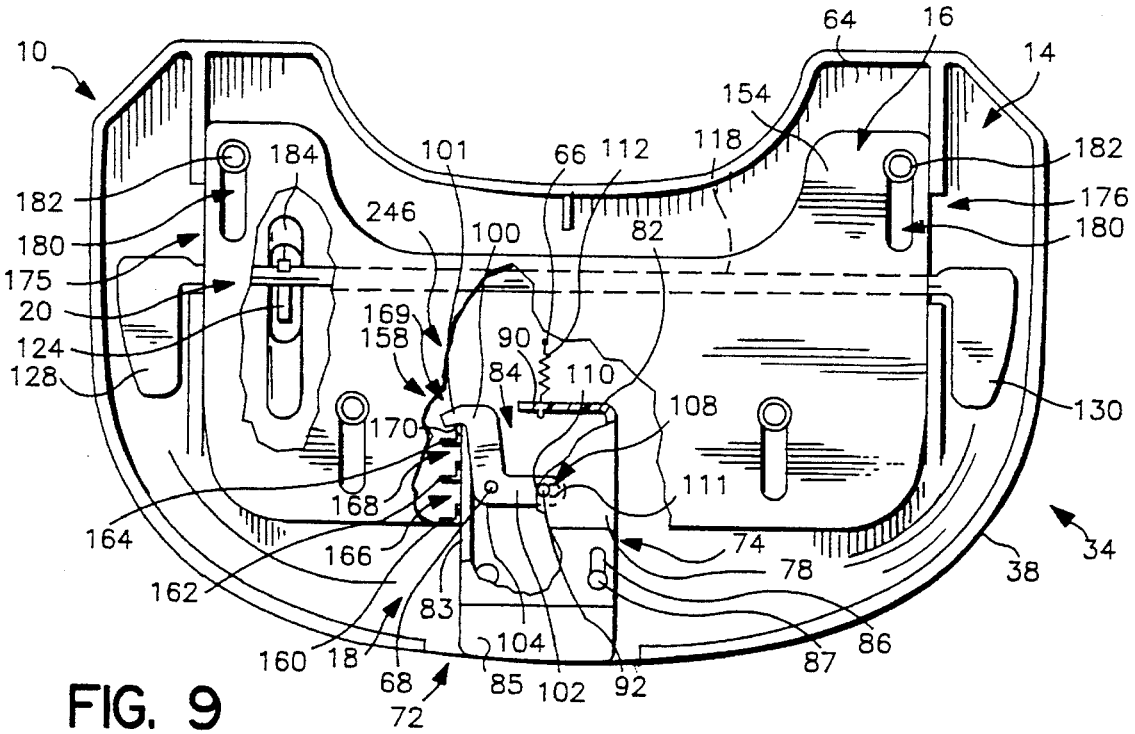
FIG. 9 is a bottom view of the child seat tray illustrated in FIG. 1, with portions broken away to reveal the mounting latch coupled to the locking bar and show a lock unit after it has moved toward the back portion of the chair and the latch has pivoted on the lock unit for engagement with the latch posts to position the tray top in the memorized retracted position relative to the back portion of the chair.
Figure 10:
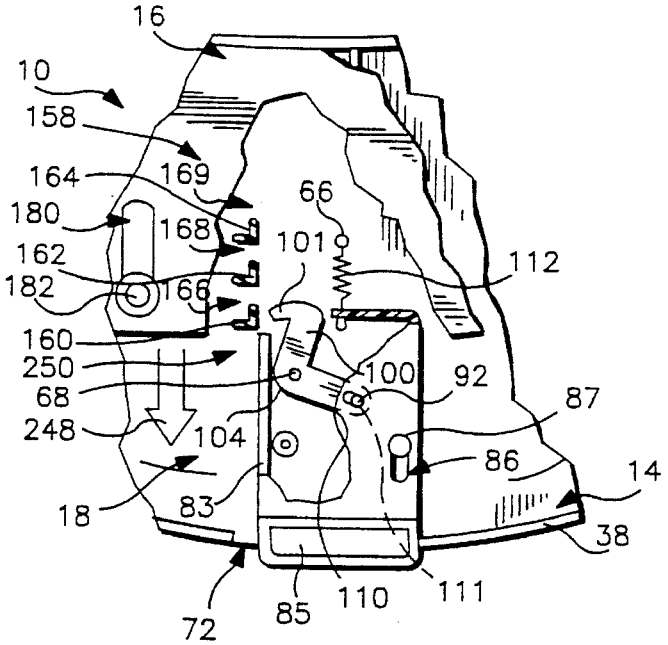
FIG. 10 is a view similar to FIG. 9 showing the lock unit after it has been pulled by a caregiver away from the back portion of the chair to pivot the latch away from the latch posts so that the tray top slides from the retracted position toward the expanded position.

Preferably, the latch posts 158 are formed and located on the tray bottom 16 to receive and engage the tab 101 of the latch 94 mounted on the tray top 14 to fasten the tray top 14 in the memorized position on the tray bottom 16. Ideally, the latch posts 158 include three outwardly extending latching posts 160, 162, 164 positioned to lie in spaced-apart relation to one another along the outer surface 156 of the tray bottom 16 as shown in FIGS. 6, 9, and 10. Moreover, mounting notches 166, 168, which are sized for insertion of the tab 101 of the latch 94 therein, extend between the latching posts 160, 162, 164. The first notch 166 extends between the first post 160 and the second post 162 and the second notch 168 extends between the second post 162 and the third post 164. Ideally, the third post 164 includes an inward face 170 formed for engagement with the tab 101 to fix the tray top 14 in the retracted position 34 as shown in FIG. 9.

The tray bottom 16 has a lip 172 positioned about the perimeter of the outer surface 156 as shown in FIG. 6. The lip 172 extends in the outward direction toward the inward side 64 of the tray top 14 to define a space 173 therebetween. Additionally, the lip 72 is formed to include an aperture 174 aligned with aperture 72 in tray top 14 so that the lock unit 74 may extend through the aligned apertures 72, 174 and away from the lip 172 as the handle 85 is pulled away from the back portion 26 of the chair 24 during manual movement of lock unit 74 by a caregiver to change the memorized position of the tray top 14 relative to the tray bottom 16.

The lip 172 is also formed to include opposite notches 175, 176 sized for pivotable placement of the locking bar 118 therein as shown in FIGS. 6, 9, and 10. The notches 175, 176 are formed in the lip 172 between the exterior side 52 and the interior side 54 of the tray bottom 16. Ideally, locking bar supports 178 are coupled to the outer surface 156 and are positioned to lie in spaced-apart relation to one another across the width of the tray bottom 16 between the opposite notches 175, 176.

Continuing to refer to FIG. 6, the tray bottom 16 includes a pair of mounting slots 180 extending between the inner surface 154 and outer surface 156. Each mounting slot 180 is sized for extension of a screw, pin, rod, headed rivet or comparable mounting device 182 therethrough to permit the mounting device 182 to couple with the tray top 14. Further, the mounting device 182 is formed for guided sliding movement in each slot 180 to permit the caregiver to move the tray top 14 freely on the tray bottom 16 between the memorized retracted position 34 shown in FIGS. 2 and 4 and the memorized expanded position 36 shown in FIGS. 3 and 5.

Figure 7:
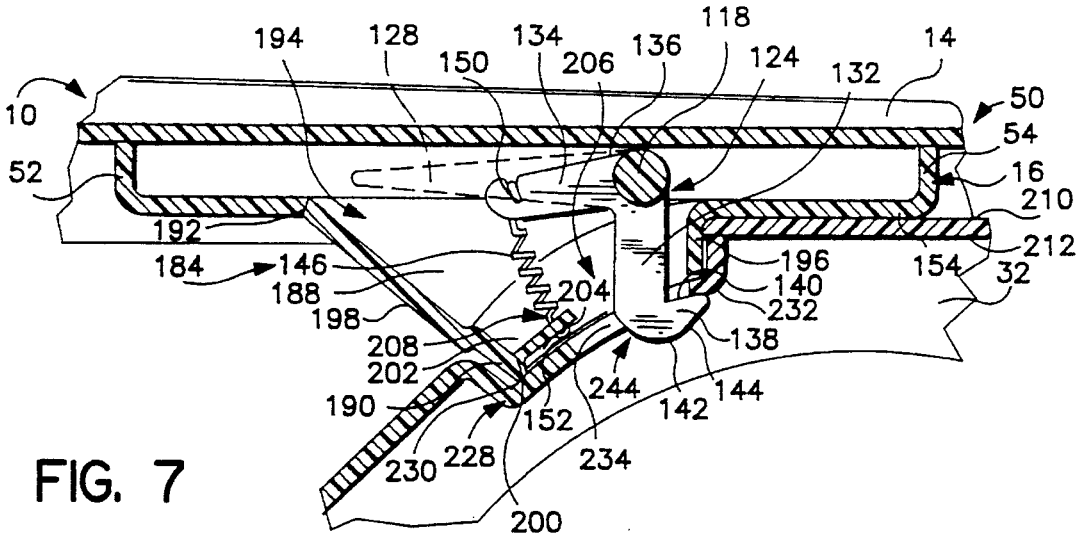
FIG. 7 is a sectional view of the child seat tray taking along line 7—7 of FIG. 1 showing a guiding portion of the tray bottom mounted on an annular rim positioned in a tray-receiving passageway of the arm of the seat and a mounting mechanism having a mounting latch pivotally mounted on a locking bar and spring biased to engage the annular rim to retain the tray bottom in a fixed position on the chair.
Figure 8:
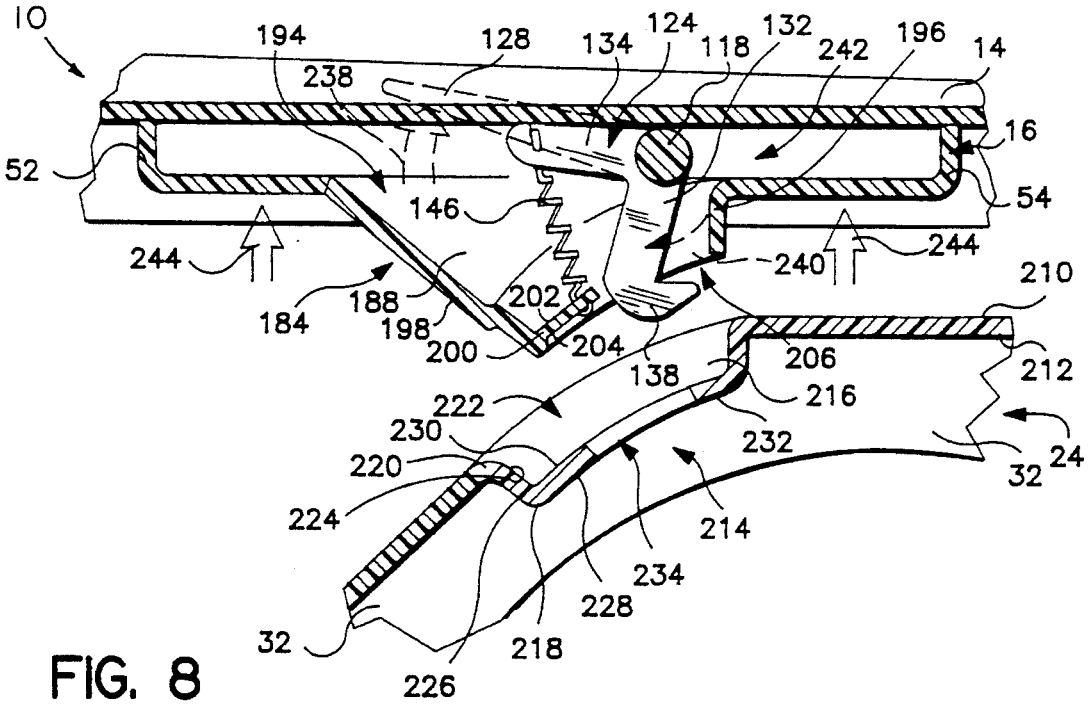
FIG. 8 is a view similar to FIG. 7, showing a latch-release lever mounted on the locking bar and in its tray mount-disengaging position pivoted out from the annular rim and showing the guiding portion of the tray bottom after the tray has been moved upwardly a short distance away from the tray-receiving passageway.

Additionally, the tray bottom 16 guides the mounting latches 124, 126 into locking engagement with the arms 32 by means of guiding portions 184, 186. These guiding portions 184, 186 extend in the inward direction from the tray bottom 16 toward the seating portion 28 of the chair 24 as shown in FIGS. 6–8. The guiding portions 184, 186 each include a conical side wall 188 (see FIG. 8) having an inner end 190, an outer end 192, and a passageway 194 communicating with the inner end 190 and the outer end 192. The wall 188 is sized for placement and retention of the mounting latches 124, 126 of the mounting mechanism 20 therein.

Preferably, the side wall 188 of each guiding portion 184, 186 is positioned on the tray bottom 16 in such a manner that it angles toward the back portion 26 as it extends in the inward direction toward the seating portion 28 of the chair 24 as shown in FIGS. 4 and 5. Thus, the side wall 188 includes a short portion 196 extending toward the seating portion 28. This short portion 196 is positioned between the locking bar 118 and the interior side 54 of the tray bottom 16. The conical side wall 188 also includes an elongated portion 198 extending at the angle to support the exterior side 52 of the tray bottom 16. The elongated portion 198 is positioned toward the exterior side 52 and extends in the inward direction while angling toward the back portion 26 of the chair 24.

Again referring to FIG. 6, a lip 200 is located in the passageway 194 of each guiding portion 184, 186. The lip 200 is formed to include an external surface 202, an internal surface 204 facing the seating portion 28, and a latch slot 206 extending between the external surface 202 and the internal surface 204. Ideally, a spring-retention aperture 208 is formed in the lip 200 between the external surface 202 and the internal surface 204 so that each locking spring 146, 148 may be held within the respective guiding portion 184, 186.

The arms 32 of the chair 24 are ideally configured to receive the respective guiding portions 184, 186 of the tray bottom 16 as shown, for example, in FIG. 6. One of the matching arms 32 is shown best in FIG. 8 and has an exterior surface 210 for supporting the tray bottom 16, an interior surface 212, and a tray mount 214 extending from the exterior surface 210 in the inward direction through the interior surface 212 and toward the seating portion 28. The tray mount 214 has a cylindrical body 216 having an inner end 218, an outer end 220, and a tray-receiving passageway 222 communicating with the inner end 218 and the outer end 220. The tray mount 214 further includes an interior surface 224 facing the passageway 222 and an exterior surface 226.

Continuing to refer to FIG. 6, the tray mount 214 preferably includes an annular rim 228 extending into the tray-receiving passageway 222 from the interior surface 224. This annular rim 228 has means for providing an annular seat for receiving the guiding portions 184, 186 of the tray bottom 16 thereon. Ideally, the rim 228 has an outwardly facing mounting lip 230 for engaging the guiding portion 184. Moreover, as shown in FIG. 7, rim 228 includes an inwardly facing latch-receiving undercut 232 for engaging the catch 138 to mount the guiding portion 184 within the tray-receiving passageway 222 following placement of the tray bottom 16 on the exterior surface 210 of the arms 32. Rim 228 also includes a mounting-latch aperture 234 extending between the mounting lip 230 and the undercut 232 and forming part of the passageway 222 as shown in FIG. 8.

Referring again to FIG. 7, the mounting-latch 124 extends through the mounting-latch aperture 234 and is spring biased against the annular rim 228 to lock the tray assembly 10 securely to the arms 32 of the chair 24. Following attachment of the tray bottom 16 to the chair 24, the inner surface 154 of the tray bottom 16 rests securely upon the exterior surface 210 of the arms 32 in the fixed position 50. In this fixed position 50, the inner end 190 of the guiding portion 184 is seated on the mounting lip 230 and positioned in the tray-receiving passageway 222.

Additionally, the locking spring 146 extends through the spring-retention aperture 208 of the guiding portion 184 between the spring-retention end 134 of the mounting-latch 124 and the internal surface 204 of the lip 200 to urge the retention end 134 of the mounting latch 124 toward the lip 200. This urging of the retention end 134 toward the seating portion 28 causes the mounting latch 124 and locking bar 118 to pivot on the tray bottom 16. This pivoting results in the locking end 132 of the mounting latch 124 extending toward the back portion 26 and through the mounting-latch aperture 234 of the tray mount 214 for engagement with the annular rim 228. Ideally, the outward portion 140 of the catch 138 engages the inwardly facing latch-receiving undercut 232 to fix the annular rim 228 securely between the catch 138 and the inner end 190 of the guiding portion 184.

Ideally, the tapered portion 144 of the catch 138 is formed to engage the outwardly facing lip 230 during insertion of the guiding portion 184 into the passageway 222. Thus, when the guiding portion 184 is pushed into the tray-receiving passageway 222, the tapered portion 144 of the catch 138 engages the outwardly facing mounting lip 230 of the annular rim 228 and guides the mounting-latch 124 away from the back portion 26 (not shown). This pressure assures alignment of the catch 138 with the mounting-latch aperture 234 and the inward movement of the mounting-latch 124 therethrough. The locking spring 146, continues to urge the retention end 134 of the mounting latch 124 normally toward the seating portion 28, so that the mounting latch 124 is pressed toward the back portion 26 of the chair 24. This pressing results in the catch 138 engaging the undercut 232 following extension of the mounting latch 124 through the mounting-latch aperture 234 as shown in FIG. 7.

Additionally, as illustrated by dotted lines in FIG. 8, pivoting movement 238 of the latch-release lever 128 relative to the tray bottom 16 causes inward movement 240 of the catch 138 away from the back portion 26 of the chair 24, through the latch slot 206 of the guiding portion 184, and away from the latch-receiving undercut 232 of the tray mount 214. This inward movement 240 of the mounting latch 124 to a tray mount-disengaging position 242 permits outward movement 244 of the catch 138 through the mounting-latch aperture 234 and the guiding portion 184 from the tray mount 214 as shown in FIG. 8. Thus, the tray bottom 16 is released from the arms 32 and the tray assembly 10 may be withdrawn easily from the seat 24.

Furthermore, the locking bar 118 pivots on the tray bottom 16 in response to the pivoting movement 238 of the latch-release lever 128 relative to the tray. bottom 16 as shown in FIG. 8. This pivoting movement 238 causes the retention end 134 of the mounting latch 124, which is fixed on the locking bar 118, to move as a unit with the latch-release lever 128. Thus, as the retention end 134 pivots on the locking bar 118 with the latch-release lever 128 away from the seating portion 28, the locking end 132 pivots in the inward direction relative to the lip 200 and away from the back portion 26. This pivoting movement 238 of the latch-release lever loads the locking spring 146. Thus, upon reaching the tray mount-disengaging position 242 and after the caregiver releases the latch-release lever 128, the loaded locking spring 146 compels an opposite pivot movement (not shown) of the latch-release lever 128 and the outward movement (not shown) of the locking end 132 to the tray mount-engaging position 236.

In addition to having a mounting mechanism 20 for fixing the tray bottom 16 into the seat 24, the assembly 10 in accordance with the present invention includes the handle 85 for pulling the lock unit 74 away from the back portion 26 of the chair 24 and pivoting the latch 94 away from the latch posts 158. Thus the caregiver is able to use handle 85 to move the tray top 14 relative to the tray bottom 16 to a new memorized position. FIG. 9 illustrates the latch 94 as it would appear in a latch post-engaging-position 246. In the latch post-engaging position 246, the pivot bar 92 of the lock unit 74 extends through the slot 108 formed in latch tail portion 102. Moreover, the head portion 100 engages the rim 83 and the tab 101 extends through the slot 84 and toward the latch posts 158 for engagement therewith. Thus, the tray top 14 is fixed securely on the tray bottom 16.

Additionally, the compression spring 112 extends between the mounting post 66 and the spring mount 90 as shown in FIG. 9 normally to urge the lock unit 74, and thus the pivot bar 92, in the inward direction relative to the convex outward edge 38 and toward the back portion 26 of the chair 24. This normal urging causes the pivot bar 92 to slide through the slot 108 and into driving engagement with the first end 110. Once the pivot bar 92 pushes against the first end 110, the latch 94 pivots about the pivot post 68 formed on the underside of the tray top 14 to move latch head portion tab 101 toward the latch posts 158 formed on the tray bottom 16. Thus, as the compression spring 112 urges the lock unit 74 in the inward direction, the latch 94 pivots toward the fixed latch post-engaging position 246. Additionally, following positioning of the latch 94 in the latch post-engaging position 246, the handle 85 is aligned inwardly from the convex outward edge 38 in the aperture 72, 174.

The tray top 14 fixed in the memorized retracted position 34 relative to the tray bottom 16 and the back portion 26 of the chair 24 as shown in FIG. 9. In the retracted position 34, the tab 101 of the head portion 100 of the latch 94 engages the third post 164 of the latch posts 154. Preferably, the tab 101 "wraps" about the inward face 170 of the third post 164 to fix the tray top 14 securely in the retracted position 34. In the memorized expanded position 36 shown in FIGS. 2 and 4, the tab 101 extends into the first mounting notch 166 and engages the first post 160 (not shown). Additionally, the tab 101 is further formed for extension into the second mounting notch 168 and for engagement with the second post 12 of the latch posts 158 to cause the tray top 14 to be fixed in a memorized intermediate position (not shown) between the retracted position 34 and the expanded position 36. It is contemplated that the latch posts 158 could be formed to accommodate a variety of intermediate positions between the retracted position 34 and the expanded position 36.

Furthermore, as illustrated in FIG. 10, the latch 94 pivots on the pivot post 68 formed on the underside of the tray top 14 in response to the outward movement 248 of the lock unit 74 relative to the tray top 14 and away from the back 26 of the chair 24. This outward movement 248 causes the extension of the handle 85 through the aperture 72, 174 and away from the convex outward edge 38 of the tray top 14. Outward movement 248 further causes movement of the pivot bar 92 in the slot 108 against second end 111 to pivot the head portion 100 away from the latch posts 158. Thus, the lock unit 74 pulls tab 101 away from the latch posts 158, toward the spring mount 90, and into a latch post-disengaging position 250. The positioning of the latch 94 in the latch post-disengaging position 250 releases the lock unit 74 from the latch posts 158 and the tray top 14 from the tray bottom 16 so that the tray top 14 may slide freely relative to the tray bottom 16 between the retracted position 34 and the expanded position 36.

Additionally, the outward movement 248 of the lock unit 74 away from the back portion 26 of the chair 24 loads the compression spring 112. Thus, upon positioning the latch 94 in the latch post-disengaging position 250 and after the caregiver releases the handle 85, the loaded compression spring 112 compels the inward movement (not shown) of the lock unit 74. Thus, the pivot bar 92 returns to the first end 110 of the slot 108 so that the latch 94 pivots on the pivot post 68 and pushes the head portion 100 into the latch post-engaging position 246.

Figure 11:
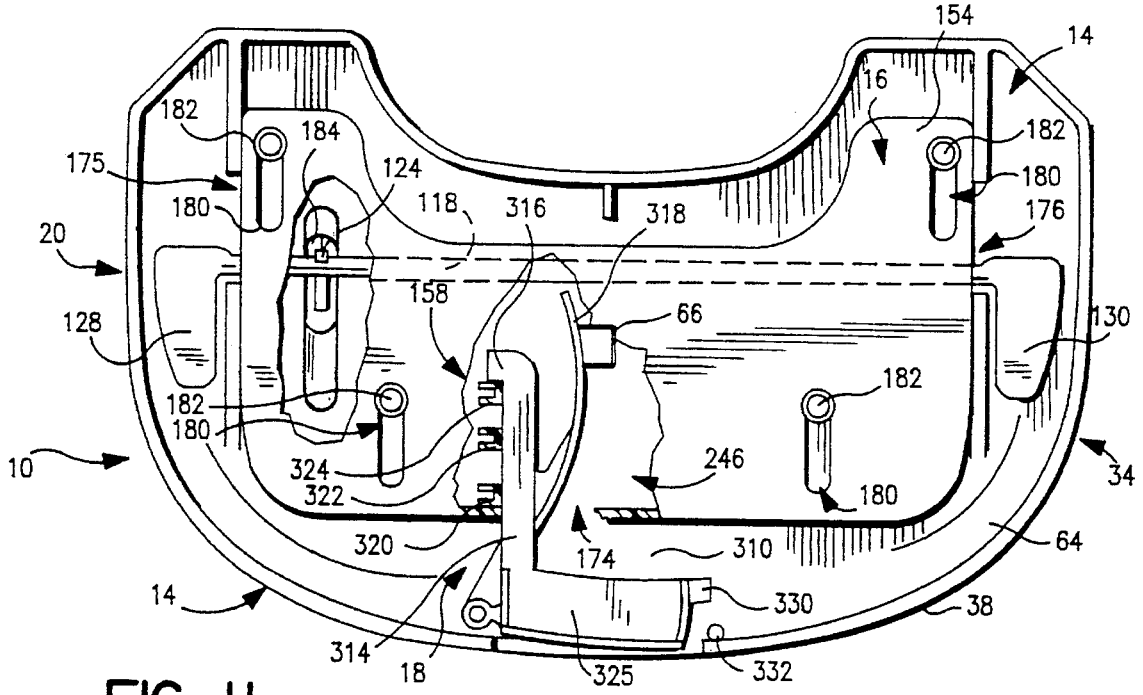
FIG. 11 is a bottom view of a child seat tray in accordance with another embodiment of the present invention, with portions broken away to reveal the mounting latch coupled to the locking bar and an locking mechanism fixing a tray top in a retracted position relative to a tray bottom, and showing the locking mechanism having a lock portion and a living spring extending between the lock portion and a mounting post to bias the lock portion into engagement with the latch posts coupled to the tray bottom.
Figure 12:
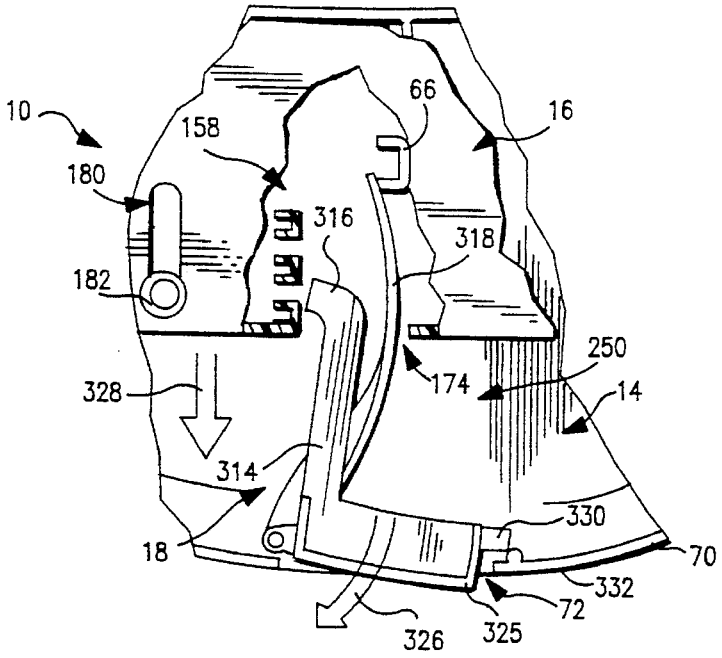
FIG. 12 is a view similar to FIG. 11 showing a handle coupled to the locking mechanism and the lock portion in its latch post-disengaging position so that the tray top slides from the retracted position toward the expanded position.

The locking mechanism 18 may further be formed to include a tray lock 310 as shown in FIGS. 11–12 for locking the tray top 14 to the tray bottom 16. The tray lock 310 includes a lock unit 314 having an outwardly extending foot portion 316 mounted thereon and a living spring 318 extending between the lock unit 314 and the mounting post 66 on the inward side 64 of the tray top 14. The tray lock 310 as it would appear in the latch post-engaging position 246 is shown in FIG. 11. The foot portion 316 protrudes in the outward direction to engage the latch posts 158. Preferably, the latch posts 158 may be formed to include three retaining bars 320, 322, 324 extending in the outward direction and positioned in spaced-apart relation to one another.

Ideally, in the latch post-engaging position 246, the foot portion 316 engages the third bar 324 of the latch posts 158 to secure the tray top 14 in the memorized retracted position 34 relative to the tray bottom 16. The living spring 318 normally urges the lock unit 314 against the latch posts 158 to force the foot portion 316 into engagement with the third bar 324, thus locking the tray top 14 in the retracted position 34.

Ideally, as illustrated in FIG. 12, a handle 325 is affixed to the lock unit 314 so that the caregiver may move the lock unit 314 away from the latch posts 158 so that the tray top 14 may be moved relative to the tray bottom 16. Independent pivoting movement 326 of the handle 325 relative to the tray top 14 causes the inward movement of the foot portion 316 away from the latch posts 158 to the latch post-disengaging position 250. This latch post-disengaging position 250 permits outward movement 328 of the tray top 14 relative to the tray bottom 16 and away from the back portion 26 of the chair 24. Thus, the tray top 14 is released from the latch posts 158 and may be moved easily across the tray bottom 16 between the retracted position 34 and the expanded position 36.

The independent pivoting movement 326 of the handle 325 is, however, limited by blocking means attached to the handle 325 and to the tray top 14. The blocking means includes a handle stop 330 positioned upon the handle 2325 opposite the lock unit 314 and a block 332 mounted on the border 70 beside the aperture 72. Thus, the outward independent pivoting movement 326 of the handle 325 through the aperture 72 and away from the back portion 26 forces engagement between the handle stop 330 and the block 332. This engagement only occurs after the lock unit 314 has moved away from the latch posts 158 to the latch post-disengaging position 250. This pivoting movement 326 further causes loading of the living spring 318. Therefore, when the caregiver releases the handle 325, the living spring 318 will force the lock unit 314 into the latch post-engaging position 246 and the handle 325 to pivot in the inward direction (not shown) toward the back portion 26.

To adjust the child seat tray assembly 10 on the seat 24, a caregiver must first grasp the handle 85 of the lock unit 74. The handle 85 is pulled in the outward direction away from the convex outward edge 38 of the tray top 14. This pulling causes the latch 94 to pivot on the pivot post 68 away from the latch posts 158 to release the tray top 14 for sliding movement relative to the tray bottom 16. After pulling the handle 85, the caregiver simply slides the tray top 14 on the tray bottom 16 to the desired retracted position 34, intermediate position (not shown), or expanded position 36.

To fix the tray top 14 to the tray bottom 16 after adjusting the positioning of the tray top 14 to accommodate the child, the caregiver must simply release the handle 85. This release allows the compression spring 112 to urge the lock unit 74 in the inward direction toward the back portion 26 of the chair 24 and the latch 94 to pivot into fixed engagement with the latch posts 158. In this manner, the caregiver can fix the "memory" of the tray top 14 in the retracted position 34, the expanded position 36, or the intermediate position (not shown) therebetween, to meet the size of the child.

To mount the child seat tray assembly 10 on the seat 24, a caregiver first grasps the tray top 14. The guiding portions 184, 186 are then aligned with the respective tray mount 214 formed in the arms 32 of the seat 24. Once aligned, the caregiver simply pushes the assembly 10 in an inward tray-mounting direction toward the seating position 28 until the caregiver feels the mounting latches 124, 126 snap into engagement with the latch-receiving undercut 232 of the tray mount 214. The snapping of the mounting latches 124, 126 creates a clicking sound which also serves as a notice to the caregiver that the assembly 10 has been successfully mounted on the seat 24.

To remove the assembly 10 from the seat 24, a caregiver simply lifts the latch-release levers 128, 130 and pulls the disengaged assembly 10 from the tray-receiving passageway 222 of the tray mount 214. The pivoting movement 238 of the latch-release levers 128, 130 causes the mounting latches 124, 126 to pivot in the guiding portions 184, 186 thereby undergoing inward movement 240 through the mounting-latch aperture 234 and away from the latch-receiving undercut 232. The assembly 10 is now in its tray mount-disengaging position 242 and can be withdrawn easily from the tray-receiving passageway 222 of the tray mount 214. Conveniently, the withdrawn assembly 10 undergoes pivoting realignment until it resumes its tray mount-engaging position 236, and thus, with the tapered portion 144 of the catch 138 positioned inwardly relative to each guiding portion 184, 186, the assembly 10 is ready to be mounted in the seat 24 for the next use.

It is easy to adjust the memorized position of the tray top 14 relative to the tray bottom 16 using little effort. The caregiver must simply pull the handle 85 which is affixed to the locking mechanism 18 and slide the tray top 14 to either the retracted position 34, the expanded position 36, or the intermediate position (not shown) therebetween. By simply releasing the handle 85, the tray top 14 is automatically locked in the new memorized position so that the tray top 14 occupies that same position every time the tray assembly 10 is mounted on the seat 12.

It is also easy to mount the child seat tray assembly 10 in accordance with the present invention on the seat 24 using very little effort. The caregiver must simply press the guiding portions 184, 186 of the tray bottom 16 into the passageway 222 of the tray mount 214 until the mounting latches 124, 126 snap into engagement with the respective latch-receiving undercut 232. Once mounted, the caregiver must only raise the latch-release levers 128, 130 and lift the assembly 10 out of the tray mount 214 to remove the assembly 10 from the chair 24.

Although the invention has been described in detail with reference to certain preferred embodiments, variations and modifications exist within the scope and spirit of the invention as described and defined in the following claims.

We claim:

1. A seat tray assembly for use with a high chair having a seat portion, a back portion, and arms, the tray assembly comprising a tray bottom formed for engagement with and extension between the arms, a tray top mounted for sliding movement on the tray bottom, the tray top being at least as wide as the tray bottom, and means for locking the tray top on the tray bottom so that the tray top occupies a pre-determined set position relative to the seat back each time the tray bottom is fixed on the arms of the high chair.

2. The assembly of claim 1, wherein the locking means includes a tray lock unit positioned between the tray top and the tray bottom, a latch movably coupled with the tray top and movably mounted on the lock unit, latch posts coupled to the tray bottom, and spring means for yieldably biasing the lock unit toward the back portion so that the latch moves into a latch post-engaging position to set the pre-determined position.

3. The assembly of claim 2, wherein the tray top includes an outward side, an inward side facing the tray bottom, and a pivot post extending from the inward side toward the tray bottom and the latch is movably coupled to the pivot post.

4. The assembly of claim 3, wherein the latch includes a head portion, a tail portion, and a central pivot portion positioned between the head and the tail portions and the central pivot portion is movably coupled to the pivot post.

5. The assembly of 2, further comprising means for moving the latch from the latch post-engaging position to a latch post-disengaging position so that the tray top is free to slide upon the tray bottom relative to the back portion.

6. The assembly of claim 5, wherein the tray top includes an outward edge and the moving means includes a handle affixed to the lock unit and arranged to move the latch toward the latch post-disengaging position upon outward movement of the handle relative to the outward edge of the tray top.

7. The assembly of claim 2, wherein the lock unit includes a bottom side and a top side, and the latch is movably joined to the top side for limited movement therewith so that the latch is yieldably biased away from the latch posts and into a latch post-disengaging position as the lock unit moves outwardly from the back portion.

8. The assembly of claim 2, wherein the tray top includes an outward side, an inward side, and means for mounting the spring means on the inward side so that the spring means extends between the tray locking unit and the tray top.

9. The assembly of claim 8, wherein the mounting means is a mounting post coupled to the inward side and arranged to extend toward the tray bottom and the spring means is positioned to extend between the mounting post and the tray locking unit.

10. The assembly of claim 1, further comprising means for mounting the tray bottom on the arms so that the tray bottom is attached to the chair in a fixed locked position, the mounting means being formed to include a locking bar extending across the tray bottom, mounting latches coupled to the bar, and spring means for normally urging the mounting latches into engagement with the arms so that the tray bottom is locked thereto.

11. The assembly of claim 10, wherein the tray bottom is formed to include an inner surface, an outer surface, and a lip extending about the perimeter of the outer surface toward the tray top, a space is defined by the lip and positioned between the tray top and the outer surface of the tray bottom, and the locking bar extends across the space and engages the lip.

12. The assembly of claim 11, wherein the mounting latches include a locking end, a spring-retention end, and a center pivot portion coupled to the locking bar and the spring means is a locking spring extending between the tray bottom and the spring-retention portion.

13. The assembly of claim 10, wherein the tray bottom is further formed to include means for positioning the mounting latches in a tray mount included with the arms of the high chair so that the mounting latches are yieldably biased into engagement with the tray mount so that the positioning means is fixed within the tray mount.

14. The assembly of claim 13, wherein the positioning means of the tray bottom includes a guiding portion having a conical side wall formed for extension into the tray mount toward the seat portion, an inner end, and an outer end, the mounting latch extends through the guiding portion and is adapted to affix an annular rim of the tray mount between itself and the inner end of the guiding portion.

15. A seat tray assembly for use with a high chair having a seat portion, a back portion, and arms, the tray assembly comprising a tray bottom formed for engagement with the arms, a tray top mounted for sliding movement on the tray bottom, the tray top including an outward side, an inward side facing the tray bottom, and a pivot post extending from the inward side toward the tray bottom, and means for locking the tray top on the tray bottom so that the tray top occupies a pre-determined set position relative to the seat back each time the tray bottom is fixed on the arms of the high chair, the locking means including a tray lock unit positioned between the tray top and the tray bottom, a latch movably coupled with the tray top, movably mounted on the lock unit, and being formed to include a head portion, a tail portion, a central pivot portion positioned between the head and the tail portions and movably coupled to the pivot post, and a pivot aperture extending therethrough and the pivot post extends through the aperture, latch posts coupled to the tray bottom, and spring means for yieldably biasing the lock unit toward the back portion so that the latch undergoes pivoting movement relative to the tray top and the latching posts and moves into a post-engaging position to set the pre-determined position.

16. A seat tray assembly for use with a high chair having a seat portion, a back portion, and arms, the tray assembly comprising a tray bottom formed for engagement with the arms, a tray top mounted for sliding movement on the tray bottom, the tray top including an outward side, an inward side facing the tray bottom, and a pivot post extending from the inward side toward the tray bottom, and means for locking the tray top on the tray bottom so that the tray top occupies a pre-determined set position relative to the seat back each time the tray bottom is fixed on the arms of the high chair, the locking means including a tray lock unit positioned between the tray top and the tray bottom, a latch movably coupled with the pivot post of the tray top and movably mounted on the lock unit, the latch including a head portion having a tab extending outwardly therefrom, a tail portion, and a central pivot portion positioned between the head and the tail portions and movably coupled to the pivot post, latch posts coupled to the tray bottom, and spring means for yieldably biasing the lock unit toward the back portion so that the latch moves and the tab engages one of the latch posts in the latch post-engaging position to fasten and set the tray top in the pre-determined position.

17. The assembly of claim 16, wherein the locking means includes three latch posts positioned to lie in spaced-apart relation to one another along the tray bottom with mounting notches extending therebetween and the tab is sized for insertion into one of the notches for engagement with one of the latch posts.

18. A seat tray assembly for use with a high chair having a seat portion, a back portion, and arms, the tray assembly comprising a tray bottom formed for engagement with the arms, a tray top mounted for sliding movement on the tray bottom, the tray top including a border extending about the perimeter of the tray top, the border being formed to include an aperture therethrough, means for locking the tray top on the tray bottom so that the tray top occupies a pre-determined position relative to the seat back each time the tray bottom is fixed on the arms of the high chair, the locking means including a tray lock unit positioned between the tray top and the tray bottom, a latch movably coupled with the tray top and movably mounted on the lock unit, latch posts coupled to the tray bottom, and spring means for yieldably biasing the lock unit toward the back portion so that the latch moves into a latch post-engaging position to set the pre-determined position, and means for moving the latch from the latch post-engaging position to a latch post-disengaging position so that the tray top is free to slide upon the tray bottom relative to the back portion, and the moving means includes a handle affixed to the lock unit, and the handle is sized for extension through the aperture.

19. The assembly of claim 18, wherein the tray top includes an outward edge, and the latch is situated in the latch post-disengaging position following movement of the handle through the aperture and away from the outward edge.

20. The assembly of claim 18, wherein the tray bottom includes an inner surface, an outer surface, and a lip positioned about the perimeter of the outer surface, the lip is formed to include an aperture therethrough, and the lock unit is sized for extension through the aperture.

21. A seat tray assembly for use with a high chair having a seat portion, a back portion, and arms, the tray assembly comprising a tray bottom formed for engagement with the arms, a tray top mounted for sliding movement on the tray bottom, and means for locking the tray top on the tray bottom so that the tray top occupies a pre-determined position relative to the seat back each time the tray bottom is fixed on the arms of the high chair, the locking means including a tray lock unit positioned between the tray top and the tray bottom, the lock unit including a bottom side, a top side, and a pivot bar extending toward the tray top from the top side, a latch movably joined to the top side of the tray top for limited movement therewith so that the latch is biased away from the latch posts and into a latch post-disengaging position as the lock unit moves outwardly from the back portion and movably mounted on the lock unit, the latch being formed to include a slot extending therethrough, and the bar extends through the slot for slidable movement therein, and spring means for yieldably biasing the lock unit toward the back portion so that the latch moves into a latch post-engaging position to set the pre-determined position.

22. The assembly of claim 21, wherein the latch includes a head portion, a tail portion, and a central pivot portion positioned therebetween, the tail portion is formed to include the slot extending therethrough, the slot includes opposite first and second ends, and the pivot bar is positioned in the first end of the slot when the head is in the latching post-engaging position.

23. The assembly of claim 22, wherein the pivot bar is positioned in the second end of the slot when the head portion is in the latching post-disengaging position.

24. A seat tray system for a chair seat having a seating portion, a back portion, and arms, the system comprising a tray bottom formed for engagement with and extension between the arms, a tray top movably mounted on the tray bottom, means for locking the tray top on the tray bottom so that the tray top is fixed in a pre-determined set position relative to the back portion of the seat, means for moving the tray top upon the tray bottom so that the tray top is released from the fixed pre-determined position and slides between a retracted fixed position and an expanded fixed position, and means for mounting the tray bottom on the arms to position the tray top in front of a child seated in the seat portion without blocking movement of the tray top between the retracted position and the expanded position.

25. The system of claim 24, wherein the locking means includes a tray lock unit positioned between the tray top and the tray bottom, a latch movably coupled with the tray top and movably mounted on the lock unit, latch posts coupled to the tray bottom, and spring means for yieldably biasing the lock unit toward the back portion so that the latch moves into a latch post-engaging position to set the pre-determined position.

26. The system of claim 25, wherein the latch includes a head portion, a tail portion, and a central pivot portion positioned therebetween and movably coupled with the tray top and the head portion is normally biased toward the latching posts.

27. The system of claim 26, wherein the head portion includes a tab extending outwardly therefrom, the tab is yieldably biased into engagement with one of the latching posts.

28. The system of claim 24, wherein the mounting means of the system includes a locking bar, mounting latches coupled to the bar, and spring means for normally urging the mounting latches into engagement with an annular rim of the tray mount so that the tray bottom is securely mounted on the arms.

29. The system of claim 28, wherein the locking bar includes opposite ends and the assembly further comprises latch-release levers positioned on the opposite ends so that the mounting latches yieldably pivot away from the annular rim as the latch-release levers are lifted away from the seating portion.

30. The system of claim 28, wherein the tray bottom includes an inner surface, an outer surface, and a lip extending along the perimeter of the outer surface and the mounting latches are positioned between the tray top and the tray bottom within the perimeter of the lip and the latch-release levers are positioned outwardly relative to the lip.

31. The system of claim 29, wherein each guiding portion includes a conical side wall having an inner end facing the seating portion, and outer end, and a lip located within the wall, the lip is formed to include a latch slot extending therethrough, and the mounting latch is biased to extend through the latch slot toward the back portion so that the annular rim is fixed between the inner end and mounting latch.

32. The system of claim 28, wherein the annular rim includes an outwardly facing mounting lip, an inwardly facing latch-receiving undercut, and a latch aperture extending between the mounting lip and the undercut, and the latch is biased to extend toward the back portion of the seat, through the latch aperture, and into engagement with the undercut.

33. A seat tray system for a chair seat having a seating portion, a back portion, and arms, the system comprising a tray bottom including a flat panel formed for extension across the seating portion between the arms and engagement with the arms, a tray top movably mounted on the tray bottom, means for locking the tray top on the tray bottom so that the tray top is fixed in a pre-determined position relative to the back portion of the seat, the locking means including a tray lock unit positioned between the tray top and the tray bottom, a latch movably coupled with the tray top, movably mounted on the lock unit, and including a head portion having a tab extending outwardly therefrom, a tail portion, and a central pivot portion positioned therebetween and movably coupled with the tray top, three outwardly appending latching posts coupled to the tray bottom and positioned to lie in spaced apart relation to one another on the flat panel with mounting notches extending therebetween and spring means for yieldably biasing the lock unit toward the back portion so that the head portion of the latch is normally biased toward the latching posts into a latch post-engaging position and the tab extends into one of the notches and engages one of the latching posts in the latch post-engaging position to set the pre-determined position, means for moving the tray top upon the tray bottom so that the tray top is released from the fixed pre-determined position and slides between a retracted fixed position and an expanded fixed position, and means for mounting the tray bottom on the arms to position the tray top in front of a child seated in the seat portion without blocking movement of the tray top between the retracted position and the expanded position.

34. The system of claim 33, wherein the tab extends into the first mounting notch and engages the first post in the fixed expanded position.

35. The system of claim 33, wherein the tab engages the third post in the fixed retracted position.

36. A seat tray system for a chair seat having a seating portion, a back portion, and arms each formed to include a tray mount therein, the tray mount includes a cylindrical body having an annular rim positioned therein, the system comprising a tray bottom formed for engagement with the arms, the tray bottom including a flat panel formed for extension across the seating portion between the arms and guiding portions extending from the panel toward the seating portion for extension through the tray mount, a tray top movably mounted on the tray bottom, means for locking the tray top on the tray bottom so that the tray top is fixed in a pre-determined position relative to the back portion of the seat, means for moving the tray top upon the tray bottom so that the tray top is released from the fixed pre-determined position and slides between a retracted fixed position and an expanded fixed position, and means for mounting the tray bottom on the arms to position the tray top in front of a child seated in the seat portion without blocking movement of the tray top between the retracted position and the expanded position, the mounting means including a locking bar, mounting latches coupled to the bar, and spring means for normally urging the mounting latches into engagement with the annular rim so that the tray bottom is securely mounted on the arms, and each guiding portion of the tray bottom is sized for placement of the mounting latch therein so that the annular rim is fixed between the guiding portion and the mounting latch when the tray bottom is fixed on the arms.

37. A seat tray system for a chair seat having a seating portion, a back portion, and arms, the system comprising a tray bottom formed for engagement with the arms, a tray top movably mounted on the tray bottom, the tray top including a border extending about the perimeter of the tray top, the border is formed to include an aperture therethrough, means for locking the tray top on the tray bottom so that the tray top is fixed in a pre-determined position relative to the back portion of the seat, means for moving the tray top upon the tray bottom so that the tray top is released from the fixed pre-determined position and slides between a retracted fixed position and an expanded fixed position, the moving means including a handle affixed to the locking means and sized for extension through the aperture, and means for mounting the tray bottom on the arms to position the tray top in front of a child seated in the seat portion without blocking movement of the tray top between the retracted position and the expanded position.

38. The assembly of claim 37, wherein the tray top includes an outward edge, and the tray top is released to slide upon the tray bottom following movement of the handle through the aperture and away from the outward edge.

39. A seat tray assembly for use on a chair seat having a back portion, a seating portion, and arms, the assembly comprising a tray top having an outward side, an inward side, and a pivot post coupled to the inward side and extending toward the seating portion, a tray bottom being formed for extension between the arms and to include an outer surface facing the tray top, an inner surface, at least one passageway extending between the outer surface and the inner surface, a locking mechanism positioned between the tray top and the tray bottom, the mechanism including a latch movably coupled to the pivot post, a lock unit movably joined with the latch, latch posts coupled to the outer surface of the tray bottom and extending toward the inward side of the tray top, and spring means for normally urging the lock unit toward the back portion and the latch into engagement with the latch posts to set the tray top in a pre-determined set locked position relative to the seat back, and a mounting mechanism including a locking bar, mounting latches coupled to the locking bar, and spring means for normally urging the latches through the passageway and into engagement with the seat so that the tray bottom is fixed in a locked position relative to the tray top.

40. The assembly of claim 39, wherein the latch includes a head portion, a tail portion, and a central pivot portion situated therebetween, and the central pivot portion is movably coupled to the pivot post.

41. The assembly of claim 40, wherein the latch further includes an outermost surface facing the tray top and an innermost surface resting on the lock unit, the pivot portion is formed to include a slot extending between the outermost surface and the innermost surface, and the lock unit and the latch are movably joined along the slot of the pivot portion.

42. The assembly of claim 39, wherein the tray bottom includes means for positioning the mounting latches within a tray mount included with the arms of the chair seat so that the mounting latches securely fix the tray bottom to the chair.

43. The assembly of claim 42, wherein the positioning means is a guiding portion surrounding each passageway and is adapted to extend in an inward direction toward the seating portion, the guiding portion includes an inner end that is adapted to be facing the seating portion and an outer end, and the mounting latch extends through the passageway and is adapted to be yieldably biased into engagement with an annular rim of the tray mount.

44. The assembly of claim 43, wherein the mounting latch includes a catch having an inward portion and an outward portion, the outward portion engages an undercut of the annular rim, and the inward end of the guiding portion is adapted to be seated on a mounting lip of the annular rim to fasten the tray bottom on the arms of the seat.

45. The assembly of claim 43, wherein the guiding portion further includes a lip positioned therein and a latch slot extending through the lip, and the mounting latch extends through the latch slot and adapted to engage the annular rim in a tray mount-engaging position.

46. A seat tray assembly for use on a chair seat having a back portion, a seating portion, and arms, the assembly comprising a tray top having an outward side, an inward side, and a pivot post coupled to the inward side and extending toward the seating portion, a tray bottom formed to include an outer surface facing the tray top, an inner surface, at least one passageway extending between the outer surface and the inner surface, a locking mechanism positioned between the tray top and the tray bottom, the mechanism including a latch movably coupled to the pivot post and being formed to include a head portion, a tail portion, a central pivot portion situated therebetween and movably coupled to the pivot post, and a pivot aperture extending therethrough and the pivot post extends through the pivot aperture, a lock unit movably joined with the latch, latch posts coupled to the outer surface of the tray bottom and extending toward the inward side of the tray top, and spring means for normally urging the lock unit toward the back portion and the latch into engagement with the latch posts to set the tray top in a pre-determined set locked position relative to the seat back, and a mounting mechanism including a locking bar, mounting latches coupled to the locking bar, and spring means for normally urging the latches through the passageway and into engagement with the seat so that the tray bottom is fixed in a locked position relative to the tray top.

47. A seat tray assembly for use on a chair seat having a back portion, a seating portion, and arms, the assembly comprising a tray top having an outward side, an inward side, and a pivot post coupled to the inward side and extending toward the seating portion, a tray bottom formed to include an outer surface facing the tray top, an inner surface, at least one passageway extending between the outer surface and the inner surface, a locking mechanism positioned between the tray top and the tray bottom, the mechanism including a latch movably coupled to the pivot post, and being formed to include a head portion, a tail portion, a central pivot portion situated therebetween and movably coupled to the pivot post, an outermost surface facing the tray top and an innermost surface, the pivot portion being formed to include a slot extending between the outermost surface and the innermost surface, and the slot includes opposite ends, a lock unit supporting and movably joined with the latch along the slot of the pivot portion and including a pivot bar extending through the slot so that the latch is in a latching post-engaging position when the pivot bar is positioned in the first end of the slot and the latch is in a latching post-disengaging position when the pivot bar is positioned in the second end of the slot, latch posts coupled to the outer surface of the tray bottom and extending toward the inward side of the tray top, and spring means for normally urging the lock unit toward the back portion and the latch into engagement with the latch posts to set the tray top in a pre-determined set locked position relative to the seat back, and a mounting mechanism including a locking bar, mounting latches coupled to the locking bar, and spring means for normally urging the latches through the passageway and into engagement with the seat so that the tray bottom is fixed in a locked position relative to the tray top.

48. A seat tray system for a chair seat having a seating portion, a back portion, and arms, the system comprising a tray bottom formed for engagement with and extension between the arms, a tray top mounted on the tray bottom for sliding movement relative to and above the tray bottom between at least two set positions, means for mounting the tray bottom on the arms to position the tray top in front of a child seated on the seat portion and in spaced-apart relation to the back portion without blocking movement of the tray top relative to the tray bottom so that the tray top is slidable relative to the tray bottom between a retracted set position close to the back portion and an extended set position away from the back portion, and means for selectively locking the slidable tray top in one of the at least two set positions on the tray bottom to cause the tray top to occupy a memory position lying on the tray bottom and having a fixed spaced-apart relation to the seat back once the tray bottom is mounted on the arms using the mounting means so that the tray top is returned automatically to the memory position each time the tray bottom is mounted on the arms.

* * * * *